US006271630B1

(12) United States Patent
Yahraus

(10) Patent No.: US 6,271,630 B1
(45) Date of Patent: Aug. 7, 2001

(54) HIGH INTENSITY DISCHARGE LIGHTING FIXTURE

(75) Inventor: Theodor G. Yahraus, Roachdale, IN (US)

(73) Assignee: Indy Lighting, Inc., Fishers, IN (US)

( * ) Notice: Subject to any disclaimer, the term of this patent is extended or adjusted under 35 U.S.C. 154(b) by 0 days.

(21) Appl. No.: 09/575,360

(22) Filed: May 22, 2000

(51) Int. Cl.[7] ..... H05B 39/10

(52) U.S. Cl. ..... 315/89; 315/61; 315/289; 362/235; 362/439

(58) Field of Search ..... 315/89, 91, 92, 315/57, 58, 61, 282, 289; 362/235, 439, 440

(56) References Cited

U.S. PATENT DOCUMENTS

Re. 36,414 * 11/1999 Tickner ..... 362/235
3,693,045 * 9/1972 Price ..... 315/91
3,949,211 * 4/1976 Elms ..... 240/25
6,095,662 * 8/2000 Burroughs et al. ..... 362/235

* cited by examiner

*Primary Examiner*—Haissa Philogene
(74) *Attorney, Agent, or Firm*—Anthony S. Zummer

(57) ABSTRACT

This invention is for an improved high intensity discharge lighting fixture. The lighting fixture includes a ballast which is adapted to be connected to a source of electric power. A first high intensity discharge socket is electrically connected to the ballast. A second high intensity discharge socket is electrically connected in parallel to the first high intensity socket and the second high intensity discharge socket is connected to the ballast in parallel with the first high intensity discharge socket.

15 Claims, 4 Drawing Sheets

HIGH INTENSITY DISCHARGE LIGHTING FIXTURE

BACKGROUND OF THE INVENTION

High intensity discharge lamps are typically used in applications where the lamp is spaced a substantial distance from the surface to be lighted, such as, a sports arena, a traffic highway interchange, a warehouse, shopping malls, atriums, or other similar applications. When the discharge lamp burns out through usage, it can be expensive and bothersome to replace the lamp. It is particularly desirable to reduce the number of times that it is necessary to re-lamp a particular fixture and avoid resulting interruptions. It is also desirable to provide a construction wherein the life of an operating fixture is extended to reduce the frequency of re-lamping the fixture.

High intensity discharge lamps are energized by an electric current to create a metallic vapor and the current through the lamp causes high intensity illumination. Lamps of this type do not illuminate instantaneously, but require time for the lamp to ignite. When a high intensity discharge lamp is fully operational and the current to the lamp is interrupted for a short period of time, the lamp will not reignite immediately. The lamp must cool down before it will reignite. The period of cooling varies from lamp to lamp. The cooling may be as short as a few minutes, or as long as twenty minutes. In certain instances the period of non-ignition of high intensity discharge lamps may be dangerous, such as, in a sports arena. A crowd of spectators could panic because of the darkness of the arena. Various systems are used to solve the problem, such as, providing an emergency lighting system in a sports arena, those systems typically providing enough light to allow sports fans to leave the arena.

It is desirable to provide a high intensity discharge lighting system in which the time between re-lamping is extended, as well as provision for instant or reduced restrike time for lamps that experience a momentary power interruption. Interruption of electric current to a first high intensity discharge lamp and re-establishment of the current ignites another high intensity discharge lamp to provide lighting in the same area as where the first lamp provided lighting.

SUMMARY OF THE INVENTION

The present invention relates to an improved high intensity discharge lighting fixture, which includes two high intensity discharge sockets. A high intensity discharge lamp is mounted in each of the sockets. Each of the sockets with its respective lamp is electrically connected in parallel to a ballast which is in turn connected to a source of electric power. The ballast provides starting voltage in parallel to both sockets. When the first lamp is struck, it begins warm-up and no current flows through the second lamp, which now has no starting voltage at its socket. The effective maintenance of the lamps is greatly reduced in view of the fact that one lamp will be operative for a period. When the lamps are restruck, the other lamp may be operative instead. Thus, there is a life balance between the two lamps and a significant increase in the life of the operative fixture. The lamps experience normal maintenance are exchanged for new lamps when both reach end-of-life, but the time for re-lamping the fixture is extended.

Should the electric current to the ballast be interrupted, the ignited lamp would cease to produce illumination. However, when the electric current is re-established to the ballast, and the first lamp which was previously ignited has not cooled sufficiently to be restruck, the current from the ballast flows through the second lamp (now ignited) and no current flows through the first lamp. The arrangement allows illumination to be produced from the fixture even if there is a short-term interruption of electric current to the fixture.

DETAILED DESCRIPTION OF THE INVENTION

Figure 1:
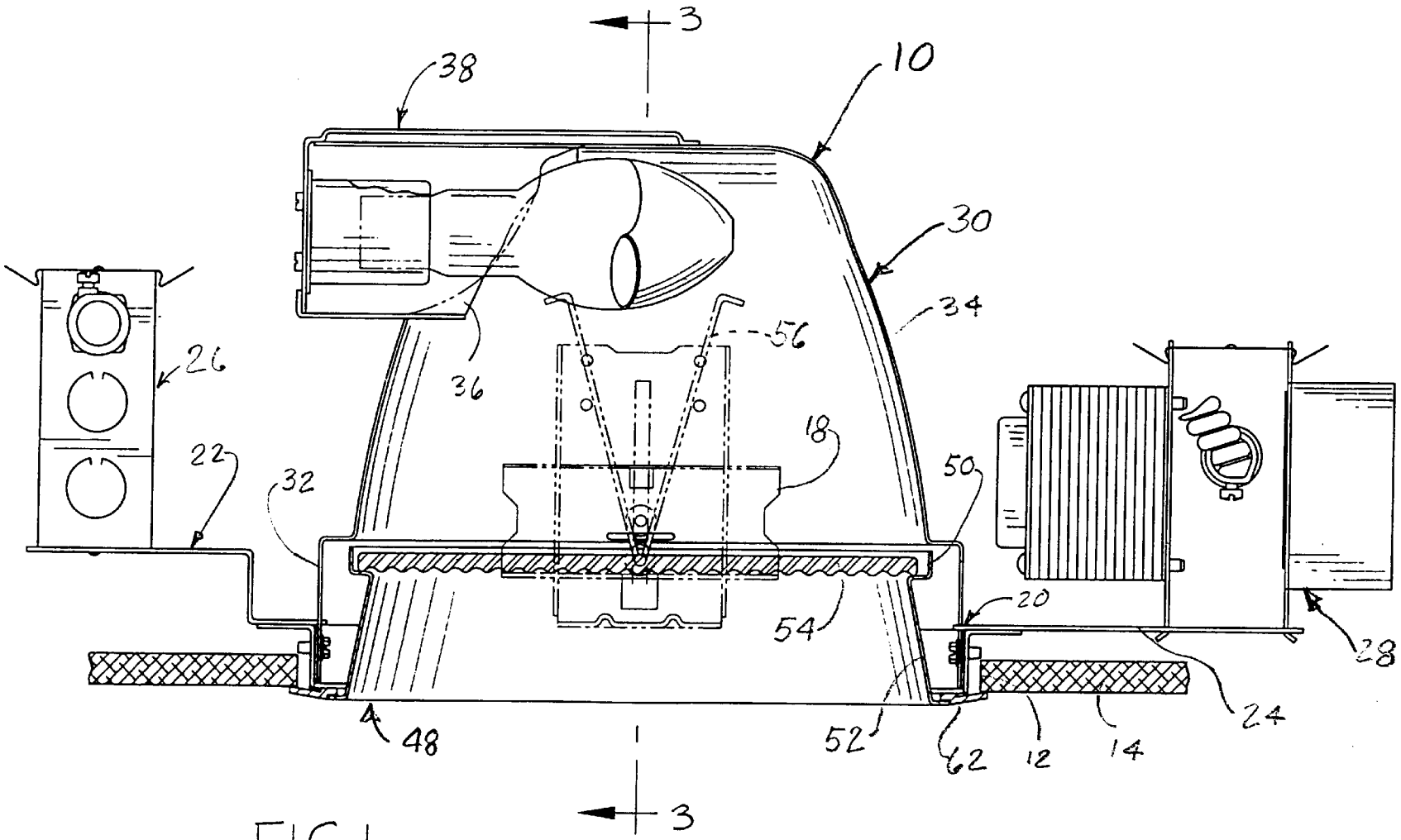
FIG. 1 is a partial cross sectional side elevational view of a high intensity discharge lighting fixture embodying the present invention.
Figure 2:
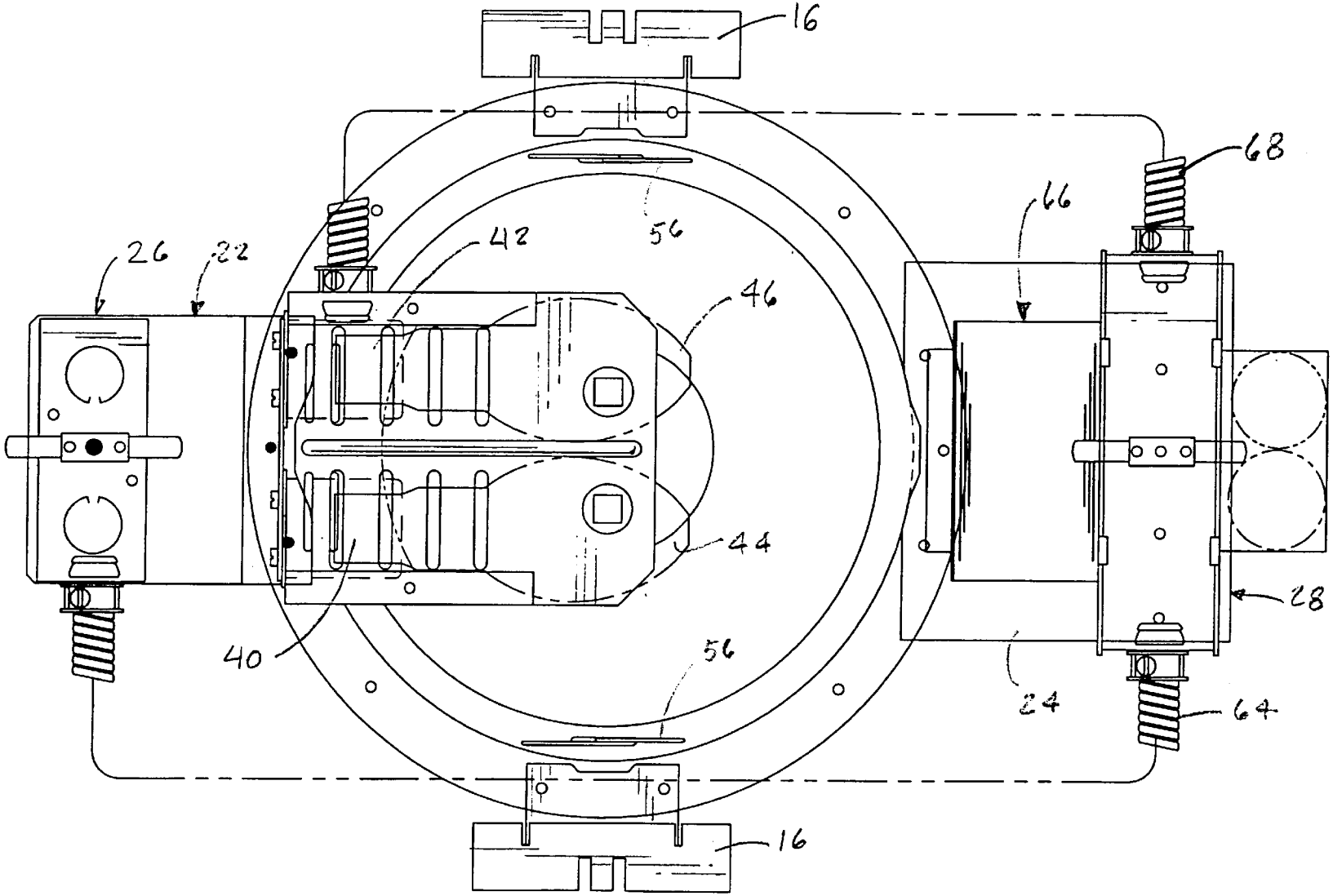
FIG. 2 is a top view of the high intensity discharge lighting fixture shown in FIG. 1.

A high intensity lighting fixture generally indicated by numeral 10 is shown in the accompanying drawings. Fixture 10 is shown as a recessed lighting fixture. However, the subject fixture may be modified to any other style of fixture commonly used for high intensity discharge lights. Fixture 10 is mounted in an aperture 12 of a conventional ceiling 14. Fixture 10 includes a pair of conventional and well known mounting posts 16 which are supported on a frame (not shown) of the ceiling 14. Each of the posts is connected to a connector bracket 18 which is slidably mounted in the respective post 16 to allow the fixture to be positioned vertically relative to ceiling 14. Fixture 10 includes a frame 20 which has a junction box platform 22 secured thereto, and a ballast platform 24 secured to the frame. A conventional junction box 26 is mounted on the junction box platform 22 and a conventional ballast 28 is mounted on platform 24.

Figure 3:
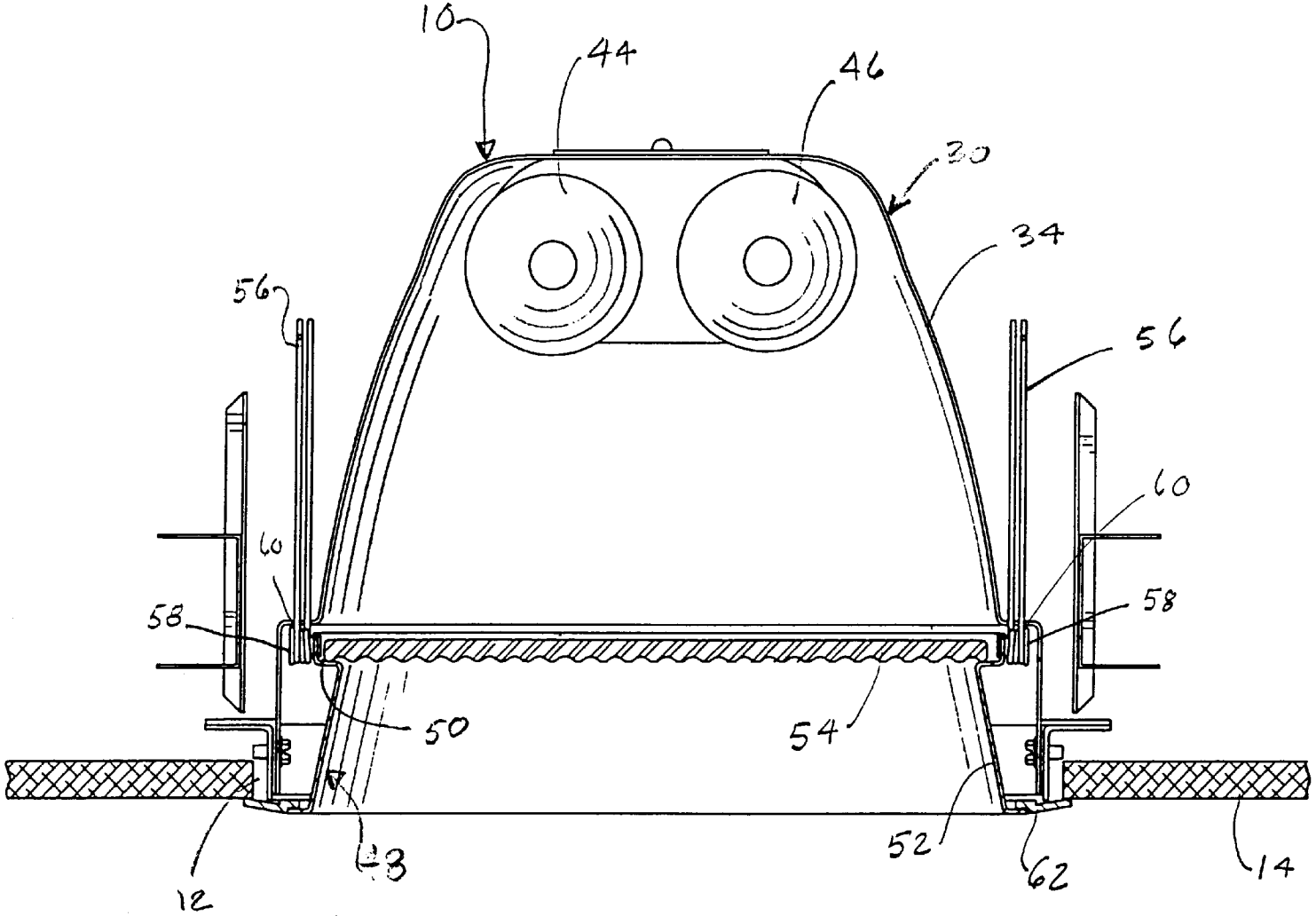
FIG. 3 is a cross sectional view taken on Line 3—3 of FIG. 1.

A reflector 30 includes a mounting edge 32 which is secured to the frame. Reflector 30 includes a conventional light reflecting surface 34 having a focal point positioned for directing light downward from the reflector, as viewed in FIGS. 1 and 3. The reflector has a lamp opening 36 which has mounted adjacent thereto a lamp support 38. Lamp support 38 has a first high intensity discharge socket 40 fixed thereto and a second high intensity discharge socket 42 also mounted on the socket support adjacent to the first socket 40. A conventional high intensity discharge lamp 44 is mounted in socket 40 and a second conventional high intensity discharge lamp 46 is mounted in socket 42. The high intensity discharge lamps 44 and 46 are in this instance standard arc metal halide lamps. However, other lamps, such as, ceramic arc metal halide lamps, protected arc metal halide lamps, or high pressure sodium lamps can be used instead. Lamps 44 and 46 are positioned adjacent to the focal point of reflecting surface 34 to direct light emitted from the lamps downward from the reflector. The lamps are positioned adjacent to each other adjacent to the focal point of the reflecting surface so that the photometric effect is substantially the same irrespective of which lamp is ignited.

A lens holder 48 is mounted in an aperture 12 adjacent to reflector 30. Lens holder 48 includes a lens recess 50 with a conical reflector surface 52 formed integral with recess 50.

An optional prismatic integrating lens 54 is positioned in recess 50. The lens holder 48 is held in position by a pair of identical torque springs 56 which are connected to the lens holder by identical pins 58. Each of the torque springs 56 extends through a slot 60 in reflector 30 to hold the lens adjacent to the reflector. A trim ring 62 is mounted on the lens holder and is positioned in engagement with ceiling 14, as is conventional.

Figure 5:
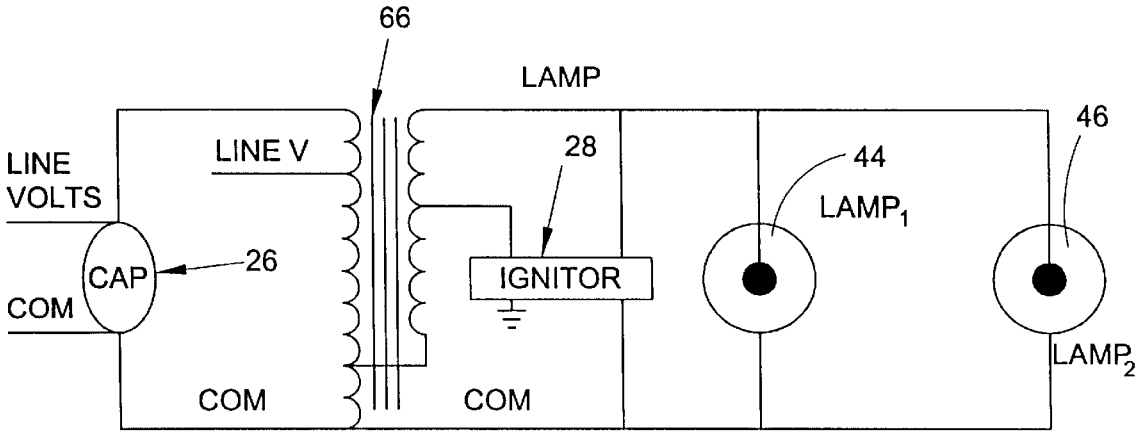
FIG. 5 is a circuit diagram showing the electric circuit of the arrangement of lamps and ballast in the high intensity discharge lighting fixture of FIG. 1.
Figure 1:
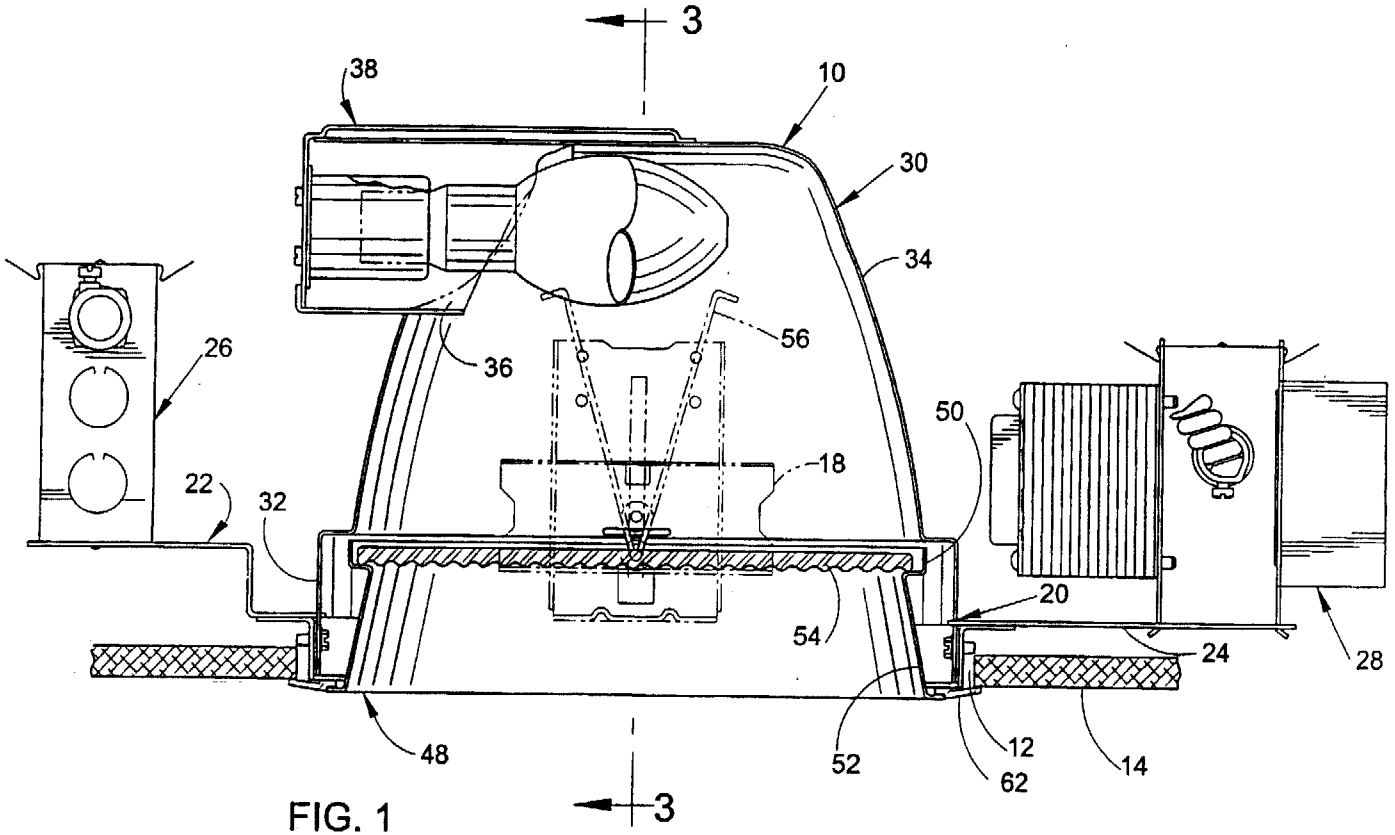
Figure 2:
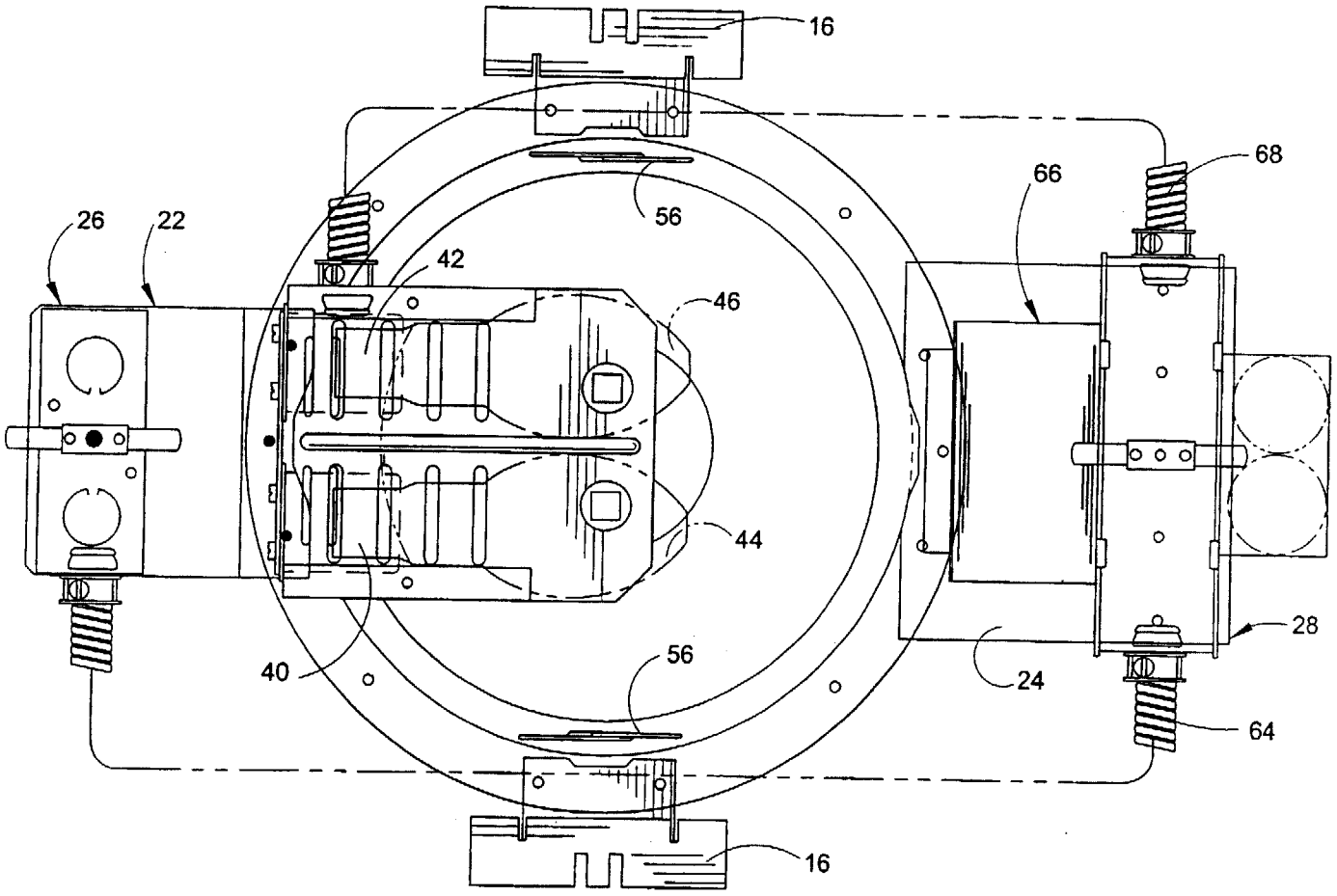
Figure 3:
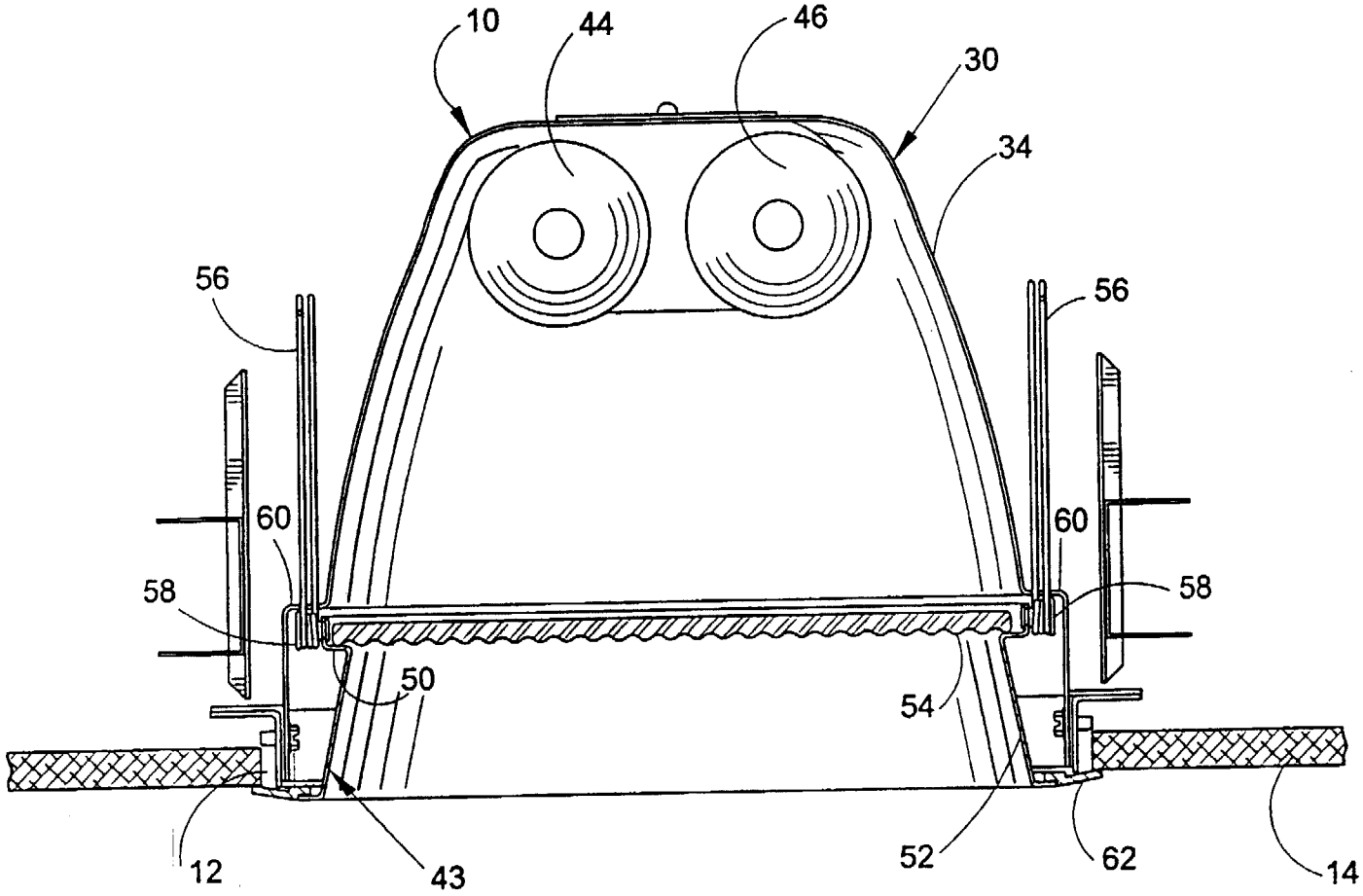
Figure 4:
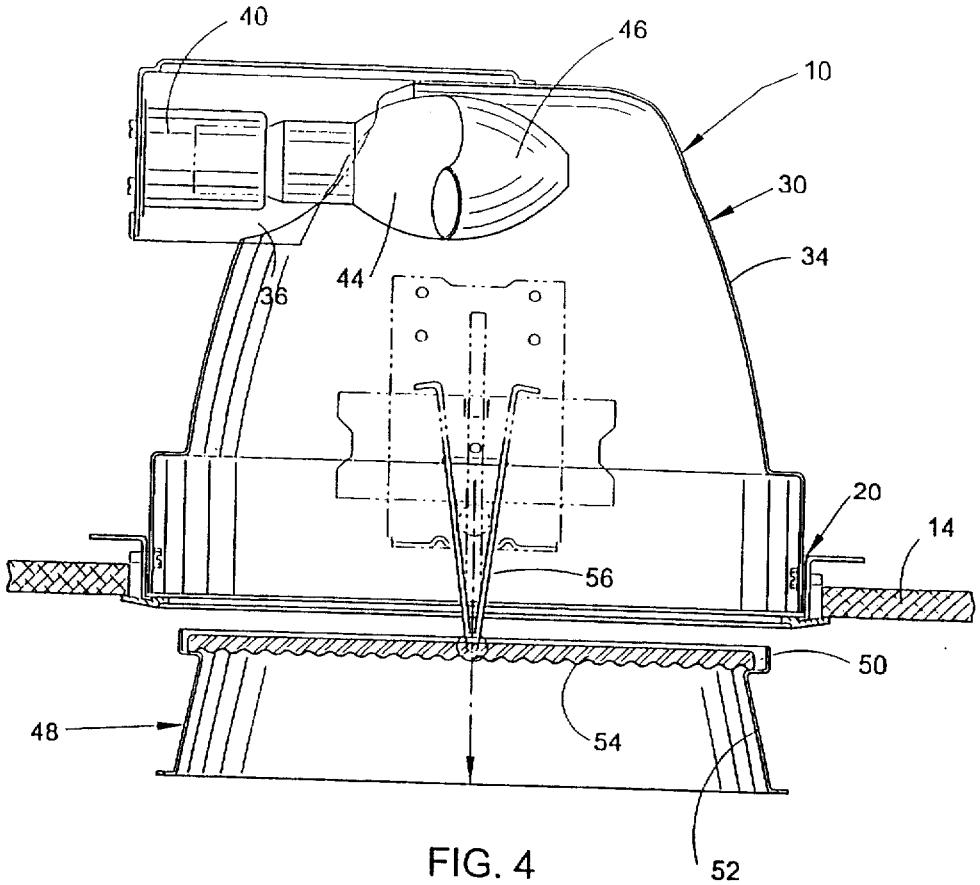
Figure 5:
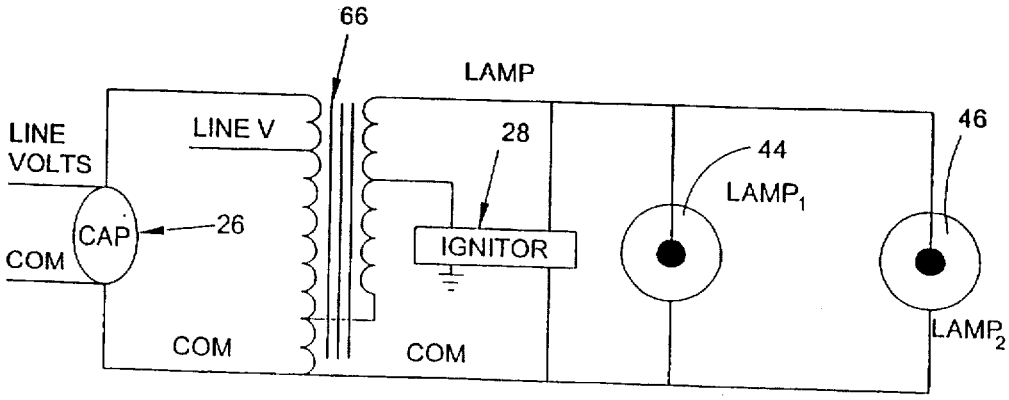

Junction box 26 is connected to a pulse start ballast 66 through conventional wiring 64. Ballast 66 also includes a conventional and well known igniter 28. The ballast and the igniter are connected to sockets 40 and 42 through conventional wiring 68. Optional constructions may include non-ignitor lamp/ballast systems whose open and starting voltage substantially exceed lamp operating voltage. Sockets 40 and 42 and the respective lamps 44 and 46 are connected in parallel to the igniter and the ballast, as shown in the electric circuit diagram of FIG. 5.

Line voltage from a conventional electric power source (not shown) is delivered to the junction box. The junction box is connected to the ballast and the igniter when used. Electric current from the igniter is delivered in parallel to lamps 44 and 46. Once one the lamps is struck, current from the ballast begins to flow through the lamp which is ignited. However, the resistance of the lamp that is not struck is such that no current flows through the lamp which is not ignited due to the cessation or ignitor voltage pulses on non-ignitor open circuit starting voltage. Thus, only one of the lamps is struck and produces illumination, which is directed by reflector 30. In the event that current is interrupted to the ballast, the ignited lamp no longer has current to power the lamp and the lamp ceases to operate. When voltage is re-established to the ballast and the igniter, starting voltage current is delivered again to the lamps 44 and 46. The lamp with the lowest resistance is struck and the lamp with the higher resistance is not ignited due to cessation of starting voltage upon ignition of first lamp. In the event that the duration of current interruption is relatively short, the lamp which was ignited is not restruck until it cools down. Thus, the lamp which was not ignited becomes the operational lamp and is struck so that the duration of lack of illumination from the fixture is reduced or eliminated.

Figure 4:
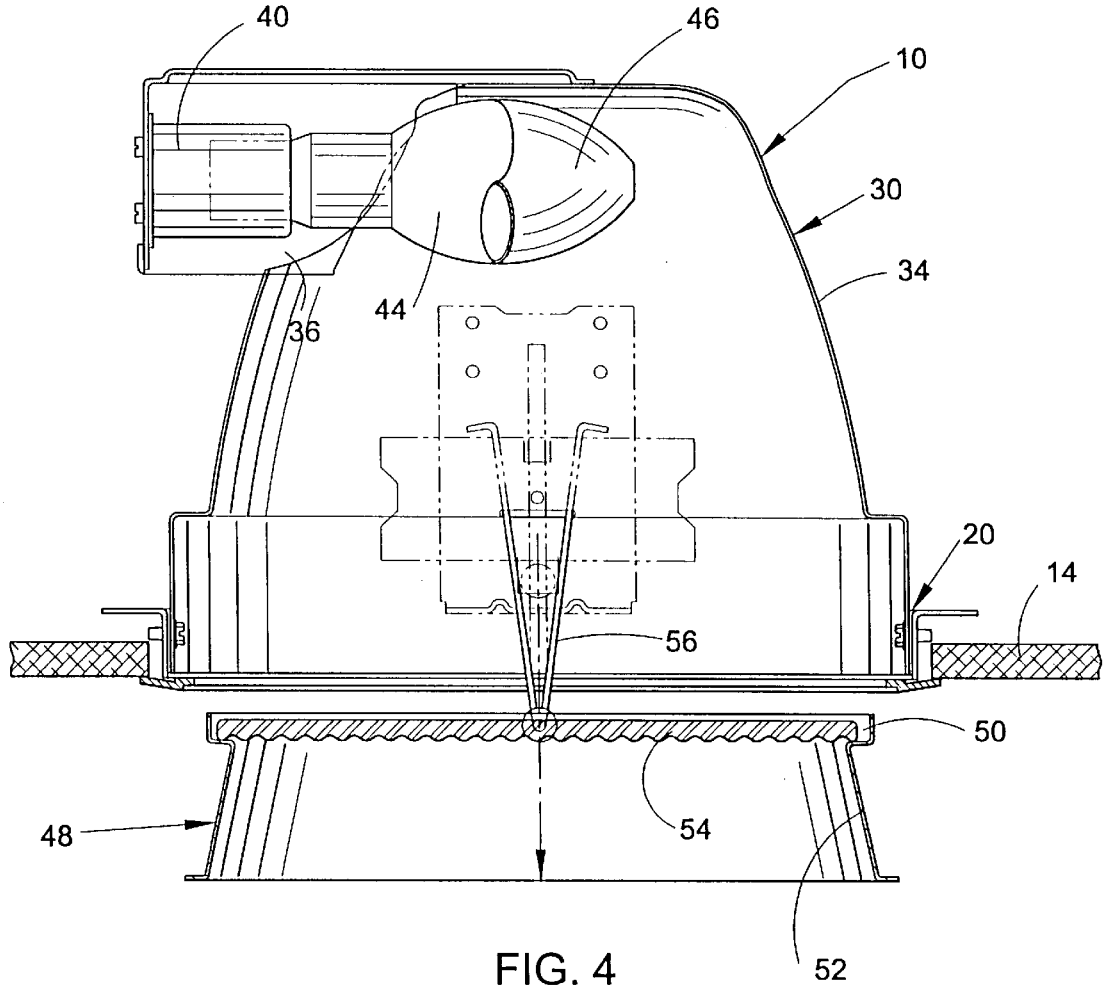
FIG. 4 is an end cross sectional view showing a lens retracted from a reflector of the high intensity discharge lighting fixture of FIG. 1.

The lamps may be changed readily simply by pulling down the optional lens holder, as shown in FIG. 4 and then tilting the lens holder to provide access to the lamps.

Inasmuch as the lamps are generally positioned in places that are not readily accessible, there is an advantage to utilizing two lamps in one position so that the lamp replacement of two lamps doubles the time between lamp changes.

The positioning of the lamps at the focus of the reflector with a prismatic integrating lens adjacent to the reflector causes the photometric effect to be substantially the same irrespective of which lamp is ignited. The optical viewing the lamps from below is such that there is no appreciable photometric difference irrespective of which lamp is ignited.

It has also been found in certain instances that an igniter is not necessary. Rather, open circuit starting voltage from the non-pulse start ballast is sufficient to ignite one of the lamps and thereby eliminate the need for an igniter.

Although a specific embodiment of the herein disclosed invention has been disclosed in detail above, it is readily apparent that those skilled in the art may make various modifications and changes without departing from the spirit and scope of the present invention. It is to be expressly understood that the instant invention is limited only by the appended claims.

What is claimed is:

1. A high intensity discharge lighting fixture, including; a ballast adapted to be connected to a source of electric power to provide electric current, a first high intensity discharge socket electrically connected to the ballast, and a second high intensity discharge socket electrically connected in parallel to the first high intensity socket, whereby the second high intensity discharge socket is connected to the ballast in parallel with the first high intensity discharge socket.

2. A high intensity discharge lighting fixture as defined in claim 1, including; a first high intensity discharge lamp electrically connected to the first high intensity discharge socket, and a second high intensity discharge lamp electrically connected to the second high intensity discharge socket, whereby electric current from the ballast to the first and second high intensity discharge lamps causes one of the lamps to strike and allows current to maintain ignition of that one lamp, while electric current does not flow through the other lamp.

3. A high intensity discharge lighting fixture as defined in claim 1, including; an igniter connected to the ballast and electrically connected in parallel to the first and second high intensity discharge sockets.

4. A high intensity discharge lighting fixture as defined in claim 1, wherein the ballast is a pulse start ballast.

5. A high intensity discharge lighting fixture as defined in claim 1, including; a lens mounted adjacent to the first and second high intensity discharge sockets, said sockets being substantially equidistantly spaced from the lens.

6. A high intensity discharge lighting fixture as defined in claim 1, including; a reflector positioned adjacent to the first and second high intensity discharge sockets, and an igniter electrically connected to the ballast and electrically connected in parallel to the first and second high intensity discharge sockets.

7. A high intensity discharge lighting fixture as defined in claim 1, including; a prismatic integrating lens positioned adjacent to the first and second high intensity discharge sockets, said sockets being substantially equidistantly spaced from the lens.

8. A high intensity discharge lighting fixture as defined in claim 1, including; an igniter electrically connected to the ballast and electrically connected in parallel to the first and second high intensity discharge sockets, and a lens positioned adjacent to the high intensity discharge sockets, said lens being equidistantly spaced from the first and second high intensity discharge sockets.

9. A high intensity discharge lighting fixture as defined in claim 1; wherein the ballast is a pulse start ballast and including, a reflector positioned adjacent to the first and second high intensity discharge sockets, a first high intensity discharge lamp electrically connected to the first high intensity discharge socket, and a second high intensity discharge lamp electrically connected to the second high intensity discharge socket, whereby electric current from the ballast to the first and second high intensity discharge lamp causes one of the lamps to ignite and allows current to maintain ignition of that one lamp while electric current does not flow through the other lamp, and the reflector directs light from the ignited light.

10. A high intensity discharge lighting fixture as defined in claim 1, including; a reflector mounted adjacent to the first and second high intensity discharge sockets, an igniter electrically connected to the ballast and electrically connected in parallel to the first and second high intensity discharge sockets, and a lens mounted adjacent to the first and second high intensity discharge sockets, said lens being substantially equidistantly spaced from the first and second high intensity discharge sockets.

11. A high intensity discharge lighting fixture as defined in claim 1, including; an igniter electrically connected to the ballast and electrically connected in parallel to the first and second high intensity discharge sockets to deliver electric current to the sockets, a first high intensity discharge lamp electrically connected to the first high intensity socket, and a second high intensity discharge lamp electrically connected to the second high intensity discharge socket, whereby electric current from the igniter to the first and second high intensity discharge lamps causes one of the lamps to ignite and allows current from the ballast to maintain ignition of the one lamp, while electric current does not flow through the other lamp.

12. A high intensity discharge lighting fixture as defined in claim 1, including; a first high intensity discharge lamp electrically connected to the first high intensity discharge socket, a second high intensity discharge lamp electrically connected to the second high intensity discharge socket, and a lens mounted adjacent to the first and second high intensity discharge lamps, said first and second high intensity discharge lamps being substantially equidistantly spaced from the lens, whereby electric current from the ballast to the first and second high intensity discharge lamp causes one of the lamps to ignite and allows current to maintain ignition of that one lamp while electric current does not flow through the other lamp, and the lens cooperates with said lamps to have substantially the same photometric effect irrespective of which lamp is ignited.

13. A high intensity discharge lighting fixture as defined in claim 1, including; an igniter electrically connected to the ballast and electrically connected in parallel to the first and second high intensity discharge sockets, a first high intensity discharge lamp electrically connected to the first high intensity discharge socket, a second high intensity discharge lamp electrically connected to the second high intensity discharge socket, a prismatic integrating lens positioned adjacent to the first and second high intensity discharge lamps, said prismatic integrating lens being equidistantly spaced from the first and second high intensity discharge lamps, whereby electric current from the igniter to the first and second high intensity discharge lamps causes one of the lamps to ignite and allows current from the ballast to maintain ignition of that one lamp while electric current does not flow through the other lamp, and the light emanating from the ignited lamp is directed by the prismatic integrating lens to be substantially photometrically the same irrespective of which lamp is ignited.

14. A high intensity discharge lighting fixture as defined in claim 1; wherein the ballast is a pulse start ballast and including, a first high intensity discharge lamp electrically connected to the first high intensity discharge socket, a second high intensity discharge lamp electrically connected to the second high intensity discharge socket, and a prismatic integrated lens mounted adjacent to the first and second high intensity discharge lamps, said first and second high intensity discharge lamps being substantially equidistantly spaced from the prismatic integrated lens, whereby electric current from the ballast to the first and second high intensity discharge lamp causes one of the lamps to strike and allows current to maintain ignition of that one lamp while electric current does not flow through the other lamp, and the prismatic integrated lens cooperates with said lamps to have substantially the same photometric effect irrespective of which lamp is ignited.

15. A high intensity discharge lighting fixture as defined in claim 1, including; a first high intensity discharge lamp electrically connected to and mounted in the first high intensity discharge socket, a second high intensity discharge lamp electrically connected to and mounted in the second high intensity discharge socket, a reflector mounted adjacent to the first and second high intensity discharge lamps for directing light emanating from the high discharge lamps, an igniter electrically connected to the ballast and electrically connected in parallel to the first and second high intensity discharge lamps, and a substantially flat prismatic integrating lens positioned adjacent to the first and second high intensity discharge lamps, said prismatic integrating lens being substantially equidistantly spaced from the first and second high intensity discharge lamps, whereby electrical current from the igniter to the first and second high intensity discharge lamps causes one of the lamps to strike and current from the ballast maintains ignition of that one lamp while electric current does not flow through the other lamp, and light emanating from the struck high intensity discharge lamp is directed by the reflector through the prismatic integrating lens to have a photometric effect substantially the same irrespective of which lamp is ignited.

* * * * *

UNITED STATES PATENT AND TRADEMARK OFFICE

CERTIFICATE OF CORRECTION

PATENT NO. : 6,271,630 B1
DATED : August 7, 2001
INVENTOR(S) : Theodor G. Yahraus It is certified that error appears in the above-identified patent and that said Letters Patent is hereby corrected as shown below:

Title page,
The title page should be deleted and substitute therefore the attached Title page.

Drawings,
Delete Drawing sheets 1-5, and substitute therefore the Drawing sheets, consisting of Figs. 1-5, as shown on the attached pages.

Signed and Sealed this

Twenty-third Day of April, 2002

*Attest:*

*Attesting Officer*

JAMES E. ROGAN
*Director of the United States Patent and Trademark Office*

(12) United States Patent
Yahraus

(10) Patent No.: US 6,271,630 B1
(45) Date of Patent: Aug. 7, 2001

(54) HIGH INTENSITY DISCHARGE LIGHTING FIXTURE

(75) Inventor: Theodor G. Yahraus, Roachdale, IN (US)

(73) Assignee: Indy Lighting, Inc., Fishers, IN (US)

( * ) Notice: Subject to any disclaimer, the term of this patent is extended or adjusted under 35 U.S.C. 154(b) by 0 days.

(21) Appl. No.: 09/575,360

(22) Filed: May 22, 2000

(51) Int. Cl.[7] ..... H05B 39/10

(52) U.S. Cl. ..... 315/89; 315/61; 315/289; 362/235; 362/439

(58) Field of Search ..... 315/89, 91, 92, 315/57, 58, 61, 282, 289; 362/235, 439, 440

(56) References Cited

U.S. PATENT DOCUMENTS

Re. 36,414 * 11/1999 Tickner ..... 362/235
3,693,045 * 9/1972 Price ..... 315/91
3,949,211 * 4/1976 Elms ..... 240/25
6,095,662 * 8/2000 Burroughs et al. ..... 362/235

* cited by examiner

*Primary Examiner*—Haissa Philogene
(74) *Attorney, Agent, or Firm*—Anthony S. Zummer

(57) ABSTRACT

This invention is for an improved high intensity discharge lighting fixture. The lighting fixture includes a ballast which is adapted to be connected to a source of electric power. A first high intensity discharge socket is electrically connected to the ballast. A second high intensity discharge socket is electrically connected in parallel to the first high intensity socket and the second high intensity discharge socket is connected to the ballast in parallel with the first high intensity discharge socket.

15 Claims, 4 Drawing Sheets

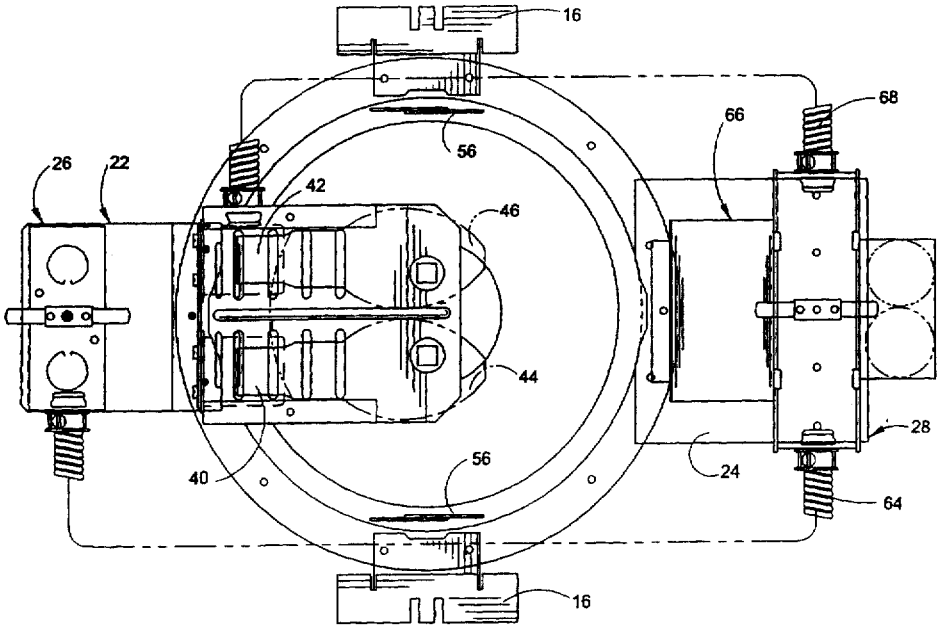

68
66
16
56
42
22
26
28
64
24
16
46
44
56
40